US008640973B2

(12) United States Patent
Gansebom

(10) Patent No.: US 8,640,973 B2
(45) Date of Patent: Feb. 4, 2014

(54) PRESSURE WASHER WAND HAVING A NOZZLE SELECTOR

(75) Inventor: Neil Gansebom, Madison, WI (US)

(73) Assignee: Briggs and Stratton Corporation, Wauwatosa, WI (US)

( * ) Notice: Subject to any disclaimer, the term of this patent is extended or adjusted under 35 U.S.C. 154(b) by 601 days.

(21) Appl. No.: 11/516,816

(22) Filed: Sep. 7, 2006

(65) Prior Publication Data

US 2008/0061167 A1 Mar. 13, 2008

(51) Int. Cl.

| | |
|---|---|
| ***A62C 31/02*** | (2006.01) |
| ***A62C 31/00*** | (2006.01) |
| ***B67D 7/08*** | (2010.01) |
| ***B67D 7/56*** | (2010.01) |
| ***B05B 9/08*** | (2006.01) |

(52) U.S. Cl.
USPC ..... 239/390; 239/394; 239/397; 239/396; 239/71; 239/437; 239/530; 239/74

(58) Field of Classification Search
USPC ..... 239/71, 380–397, 436–541, 239/581.1–582.1
See application file for complete search history.

(56) References Cited

U.S. PATENT DOCUMENTS

| | | | | | |
|---|---|---|---|---|---|
| 630,468 | A | * | 8/1899 | Quayle | 239/383 |
| 659,714 | A | * | 10/1900 | Storm | 239/394 |
| 1,364,424 | A | * | 1/1921 | Baker | 239/394 |
| 2,313,994 | A | * | 3/1943 | Grant | 239/440 |
| 2,416,719 | A | * | 3/1947 | Stockdale | 239/480 |
| 3,225,972 | A | * | 12/1965 | Brumbach | 222/516 |
| 3,363,842 | A | * | 1/1968 | Burns | 239/441 |
| 3,377,028 | A | * | 4/1968 | Bruggeman | 239/394 |
| 3,514,042 | A | * | 5/1970 | Freed | 239/458 |
| 3,516,611 | A | * | 6/1970 | Piggott | 239/391 |
| 3,936,002 | A | * | 2/1976 | Geberth, Jr. | 239/455 |
| 3,982,698 | A | | 9/1976 | Anderson | |
| 4,141,504 | A | | 2/1979 | Anderson | |
| 4,204,614 | A | * | 5/1980 | Reeve | 222/153.14 |

(Continued)

FOREIGN PATENT DOCUMENTS

| | | |
|---|---|---|
| DE | 8715909 | 7/1988 |
| DE | 197 09 120 | 9/1998 |

(Continued)

OTHER PUBLICATIONS

Product Description, Karcher Commercial Website Karcher Cleaning Systems: Karcher Commercial Products: Touchless Changeover Nozzles accessed at: http://www.karchercommercial.com/showProductModels.aspx?areaID=15&typeID=39&seriesID=158 on Feb. 21, 2006.

(Continued)

*Primary Examiner* — Len Tran
*Assistant Examiner* — Steven M Cernoch
(74) *Attorney, Agent, or Firm* — Michael Best & Friedrich LLP

(57) ABSTRACT

A pressure washer wand assembly configured to discharge pressurized fluid in a changeable spray pattern. The wand assembly comprises a tube portion having an input end and an output end. A nozzle assembly has a plurality of selectable nozzles, and the nozzle assembly is disposed near the output end and configured to discharge the pressurized fluid in a spray pattern. A nozzle indicator is spaced from the output end and indicates a spray characteristic of a selected nozzle.

34 Claims, 12 Drawing Sheets

(56) References Cited

U.S. PATENT DOCUMENTS

| | | | | | |
|---|---|---|---|---|---|
| 4,303,201 | A * | 12/1981 | Elkins et al. | 239/381 |
| 4,618,100 | A * | 10/1986 | White et al. | 239/440 |
| 4,640,461 | A * | 2/1987 | Williams | 239/317 |
| 4,664,313 | A * | 5/1987 | Yoneda | 239/456 |
| 4,858,830 | A * | 8/1989 | Proctor et al. | 239/313 |
| 4,903,897 | A * | 2/1990 | Hayes | 239/394 |
| 4,976,467 | A | 12/1990 | Paige | |
| 5,012,979 | A * | 5/1991 | Williams | 239/416.5 |
| 5,125,579 | A * | 6/1992 | Eggert | 239/439 |
| 5,217,166 | A | 6/1993 | Schulze et al. | |
| 5,328,097 | A | 7/1994 | Wesch et al. | |
| 5,386,940 | A * | 2/1995 | Berfield | 239/394 |
| 5,409,168 | A * | 4/1995 | Nelson et al. | 239/222.17 |
| 5,415,348 | A * | 5/1995 | Nelson | 239/71 |
| 5,566,886 | A * | 10/1996 | Wang | 239/394 |
| 5,690,282 | A * | 11/1997 | Guo | 239/395 |
| 5,722,597 | A * | 3/1998 | Guo | 239/395 |
| 5,770,121 | A | 6/1998 | Wang et al. | |
| 5,772,121 | A * | 6/1998 | Wang | 239/394 |
| 5,884,847 | A | 3/1999 | Christopher | |
| 5,979,800 | A * | 11/1999 | Takagi | 239/440 |
| 6,123,272 | A | 9/2000 | Havican et al. | |
| 6,216,965 | B1 * | 4/2001 | Chao | 239/587.4 |
| 6,273,343 | B1 * | 8/2001 | Guo | 239/394 |
| 6,286,767 | B1 * | 9/2001 | Hui-Chen | 239/394 |
| 6,341,737 | B1 * | 1/2002 | Chang | 239/394 |
| 6,364,219 | B1 * | 4/2002 | Zimmerman et al. | 239/394 |
| 6,398,134 | B1 * | 6/2002 | Hickson et al. | 239/394 |
| 6,402,053 | B1 * | 6/2002 | Chih | 239/310 |
| 6,425,537 | B1 * | 7/2002 | Nielsen | 239/443 |
| 6,435,427 | B1 | 8/2002 | Conroy | |
| 6,508,415 | B2 | 1/2003 | Wang | |
| 6,554,213 | B2 * | 4/2003 | Chen | 239/394 |
| 6,572,032 | B2 * | 6/2003 | Chih | 239/375 |
| 6,651,909 | B1 | 11/2003 | Bugarin | |
| 6,758,413 | B1 * | 7/2004 | Chen | 239/525 |
| 6,880,803 | B2 | 4/2005 | Kassulat et al. | |
| 6,896,206 | B1 * | 5/2005 | Chen | 239/437 |
| 6,913,211 | B2 * | 7/2005 | Chen | 239/532 |
| 6,964,380 | B1 * | 11/2005 | Chen | 239/315 |
| 6,981,661 | B1 * | 1/2006 | Chen | 239/532 |
| 7,083,120 | B2 * | 8/2006 | Gilpatrick et al. | 239/397 |
| 7,137,575 | B2 * | 11/2006 | Yoneda | 239/513 |
| 7,159,797 | B1 | 1/2007 | Lammers | |
| 7,281,673 | B2 | 10/2007 | Burnworth et al. | |
| 7,434,751 | B1 * | 10/2008 | Chen | 239/526 |
| 7,578,453 | B1 * | 8/2009 | Wilson | 239/437 |
| 2005/0098658 | A1 * | 5/2005 | Burke | 239/525 |
| 2005/0133614 | A1 * | 6/2005 | Chen | 239/71 |
| 2005/0263623 | A1 * | 12/2005 | Hofer | 239/589 |
| 2006/0016913 | A1 * | 1/2006 | Lo | 239/532 |

FOREIGN PATENT DOCUMENTS

| | | | |
|---|---|---|---|
| DE | 19709120 | A1 * | 9/1998 |
| EP | 0638366 | | 2/1995 |
| GB | 2224479 | A * | 5/1990 |
| GB | 2409181 | | 6/2005 |
| JP | 57-177558 | | 11/1982 |
| WO | WO 00/76671 | | 12/2000 |
| WO | WO 2004/052548 | | 6/2004 |
| WO | WO 2004052548 | A1 * | 6/2004 |

OTHER PUBLICATIONS

Product Description, Ex-Cell Pressure Washers: XR2625 Pressure Washer accessed at: http://www.excellpressurewasher.com/xr2625.asp on May 15, 2006.

* cited by examiner

PRESSURE WASHER WAND HAVING A NOZZLE SELECTOR

BACKGROUND

The present invention relates to pressure washers, and particularly to pressure washers capable of using multiple user-selected nozzles.

Pressure washers provide a supply of high-pressure fluid, such as water alone or water mixed with a cleaning solution, for cleaning or moving debris. Different nozzles are required for different jobs. For example, a wide angle nozzle may be suitable for cleaning loose debris off of a flat surface, while a narrower spray angle nozzle may be required to remove paint or stains from a surface. It is often desirable to be able to quickly switch between nozzles to provide the user with a wide range of functionality.

Nozzles are often disposed in a nozzle turret. Conventional nozzle turrets may be cumbersome and difficult to use because changing nozzles and selecting a different spray pattern may prove unwieldy in the midst of a pressure washer cleaning project.

SUMMARY

In one embodiment, the invention provides a pressure washer wand assembly configured to discharge pressurized fluid in a changeable spray pattern. The wand assembly comprises a tube portion having an input end and an output end. The wand assembly further comprises a nozzle assembly having a plurality of selectable nozzles. The nozzle assembly is disposed near the output end and configured to discharge the pressurized fluid in a spray pattern. The wand assembly includes a nozzle indicator spaced from the output end that indicates a spray characteristic of a selected nozzle. In one embodiment, the wand assembly further comprises an elongated outer housing coupled to the nozzle assembly and configured to rotate with respect to the tube portion to select a nozzle from the nozzle assembly at the output end.

In another embodiment, the invention provides a pressure washer wand assembly configured to discharge pressurized fluid in a changeable spray pattern. The wand assembly comprises a tube portion having an input end and an output end. The wand assembly further comprises a nozzle assembly having a plurality of selectable nozzles. The nozzle assembly is disposed near the output end and configured to discharge the pressurized fluid in a spray pattern. The wand assembly further comprises a nozzle selector spaced from the output end. The nozzle selector is configured to select a nozzle from the nozzle assembly at the output end. A nozzle indicator may be disposed on or near the nozzle selector.

In another embodiment, the invention provides a pressure washer wand assembly configured to discharge pressurized fluid in a changeable spray pattern. The wand assembly comprises a tube portion having an input end and an output end. The wand assembly further comprises a nozzle assembly having a plurality of selectable nozzles. The nozzle assembly is disposed near the output end and configured to discharge the pressurized fluid in a spray pattern. The wand assembly further comprises an elongated, rotatable outer housing, a nozzle selector, and a nozzle indicator. The nozzle selector is spaced from the output end and configured to select a nozzle from the nozzle assembly. The nozzle indicator is spaced from the output end to indicate a spray characteristic of a selected nozzle. In one embodiment, the elongated, rotatable outer housing is coupled to the nozzle assembly and configured to rotate with respect to the tube portion to select a nozzle from the nozzle assembly at the output end.

Other aspects of the invention will become apparent by consideration of the detailed description and accompanying drawings.

Before any features of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "having", and "comprising" and variations thereof herein is meant to encompass the items listed thereafter and equivalents thereof as well as additional items. The use of letters to identify elements of a method or process is simply for identification and is not meant to indicate that the elements should be performed in a particular order.

DETAILED DESCRIPTION

Figure 1:
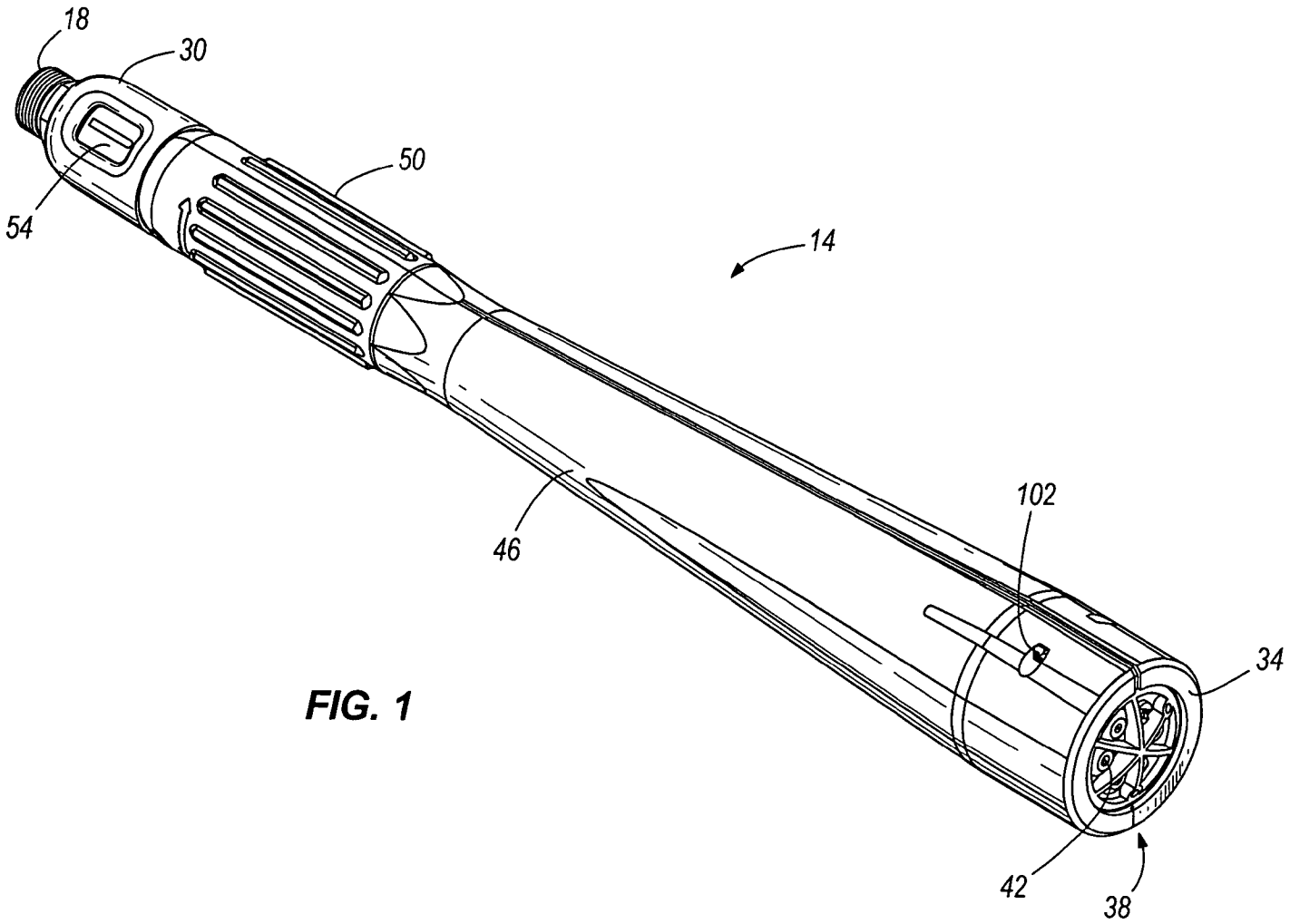
FIG. 1 is a perspective view of a pressure washer wand assembly.
Figure 2:
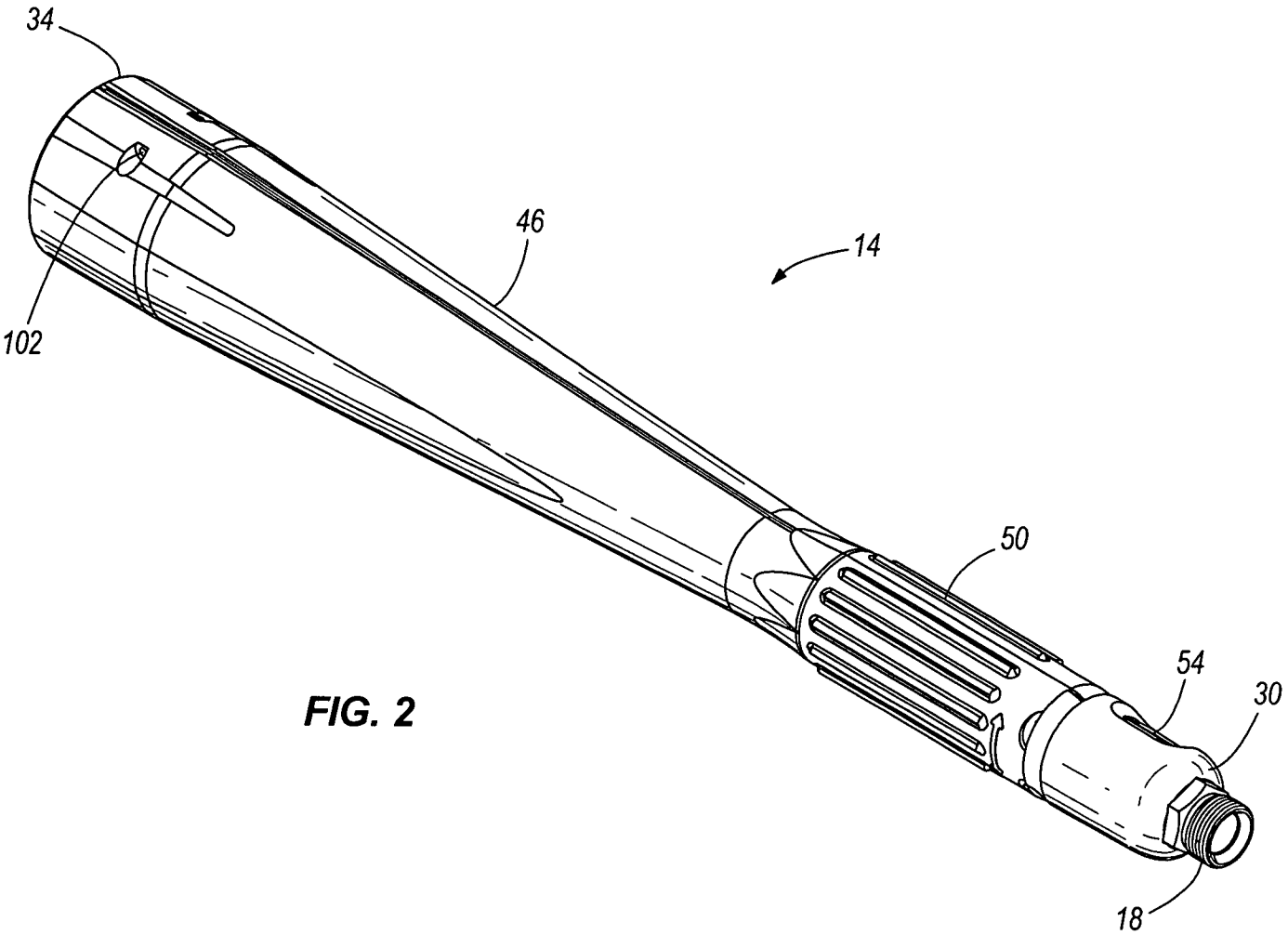
FIG. 2 is a rear perspective view of the pressure washer wand assembly shown in FIG. 1.
Figure 3:
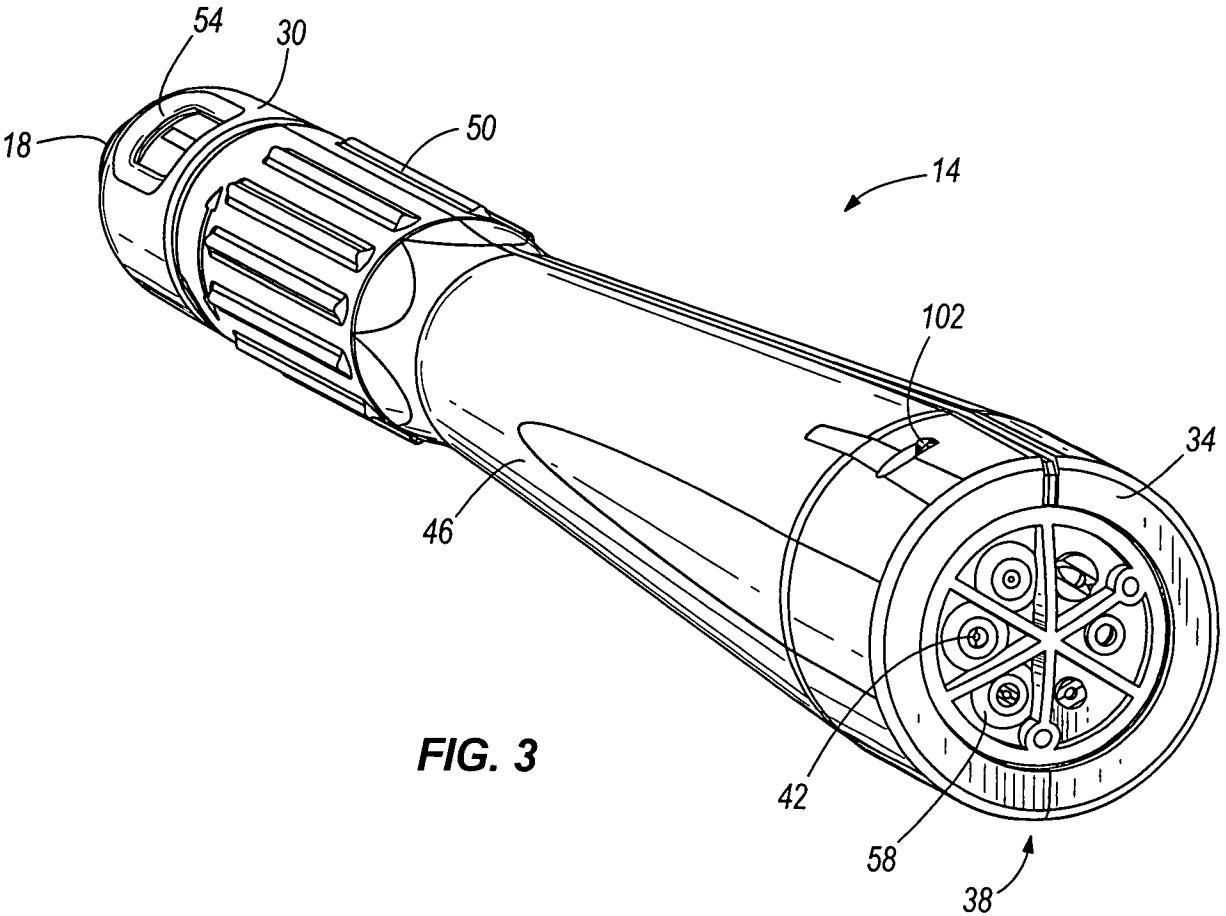
FIG. 3 is a front perspective view of the pressure washer wand assembly shown in FIG. 1.

FIGS. 1-3 illustrate a pressure washer wand assembly 14 of the present invention. The wand assembly 14 includes an input end 30 and an output end 34. A nozzle assembly 38, including a plurality of nozzles 42, is located at the output end 34. The wand assembly 14 further comprises an elongated outer housing 46, wherein the elongated outer housing 46 includes a hand grip 50 for the operator's second hand. In the illustrated embodiment, the hand grip 50 is located near the input end 30. However, in other embodiments, the hand grip 50 is located between the input end 30 and the output end 34. The wand assembly 14 further includes a viewing window 54 as part of the nozzle indicator 70, and the fitting 18 to connect the wand assembly 14 to a gun assembly, pump, or similar device.

Figure 4:
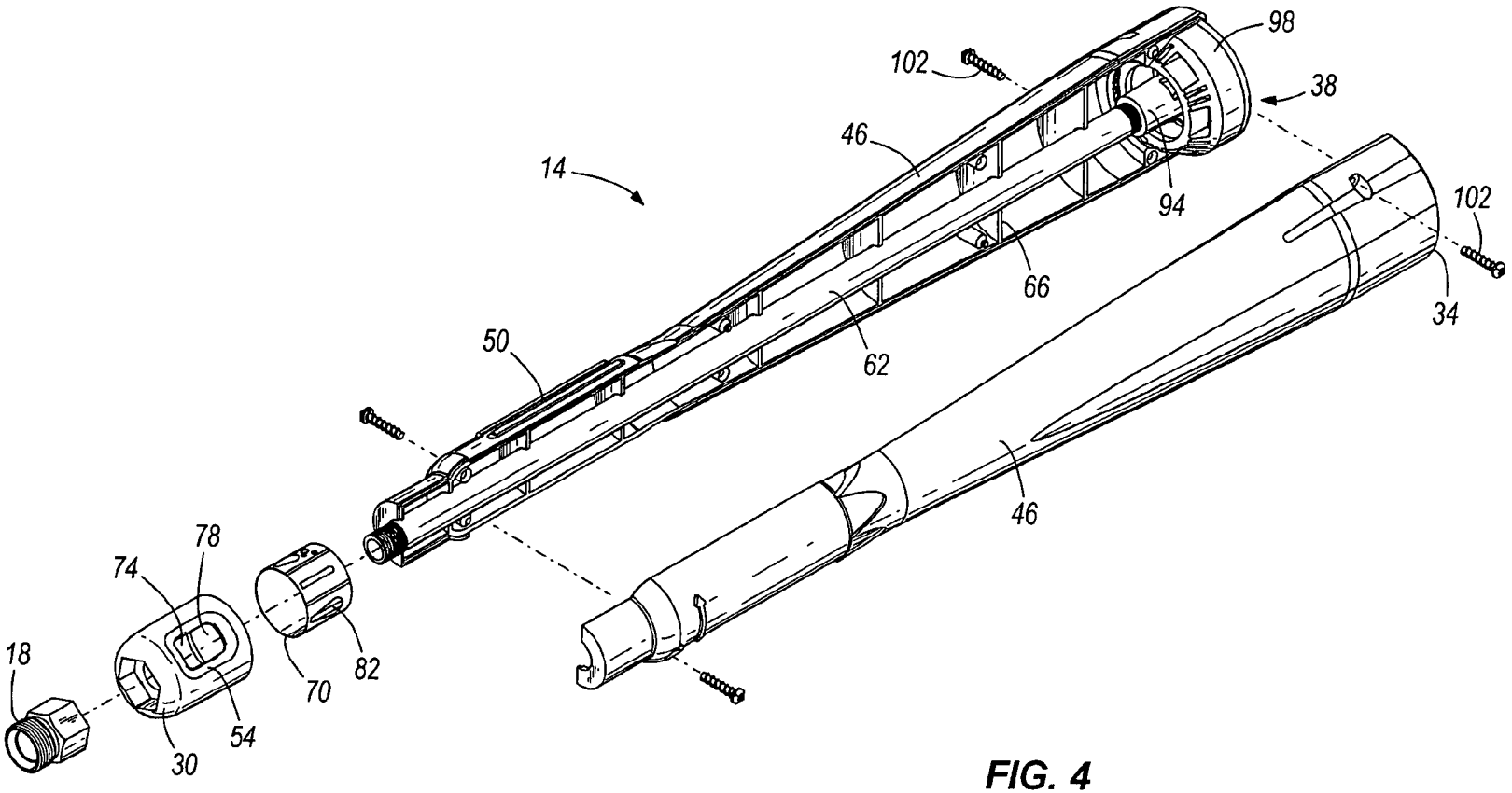
FIG. 4 is an exploded view of the pressure washer wand assembly shown in FIG. 1.
Figure 5:
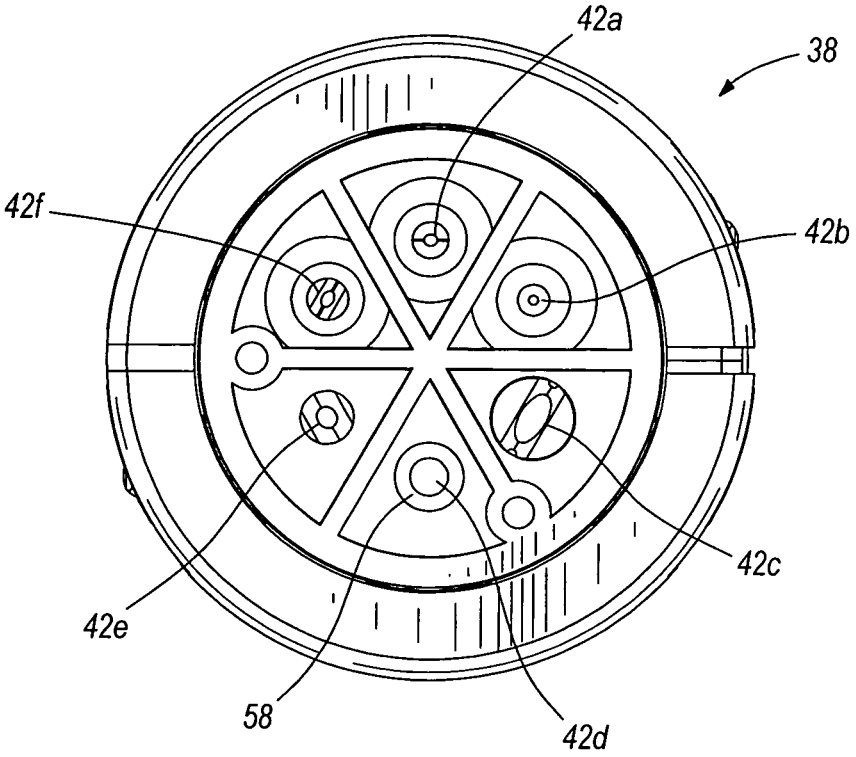
FIG. 5 is a front view of the pressure washer wand assembly shown in FIG. 1.

FIG. 4 illustrates the various components of the wand assembly 14. A nozzle assembly 38 is coupled to the output end 34 of the wand assembly 14 with a nozzle assembly collar 98 at the exterior of the output end 34. The nozzle assembly 38 includes a nozzle assembly index 39, a nozzle assembly collar 98, a nozzle coupler 94 and a plurality of apertures 58, with each of the apertures containing a nozzle 42. In some embodiments, the nozzles 42 are integrally formed in the nozzle assembly 38. In other embodiments, the nozzles 42 may be removable. The nozzles 42 are configured to exhibit respective different discharge characteristics, or spray characteristics, of the pressurized fluid. Specifically, as illustrated in FIG. 5, each of nozzles 42*a*, 42*b*, 42*c*, 42*d*, 42*e* and 42*f* includes an orifice 58 to discharge the pressurized fluid at different output pressures and flows. The sizes of the orifices 58 of the respective nozzles 42*a*, 42*b*, 42*c*, 42*d*, 42*e* and 42*f*, together with their respective spray angles, define different spray patterns. The orifice size and spray angle are selected to produce different output spray characteristics. Thus, the user may select one of the nozzles 42*a*, 42*b*, 42*c*, 42*d*, 42*e* and 42*f* to change the spray pattern according to a particular user application.

In the illustrated construction, the nozzle assembly index 39 is an insert, turn and pin design wherein the nozzle assembly index 39 is attached to the nozzle assembly collar 98 with a pin 33. Pin 33 couples the nozzle assembly index 39 to the nozzle assembly collar 98 to hold the nozzle assembly index 39 and the nozzle assembly collar 98 together for rotation. In some embodiments, the pin 33 may include a screw, bolt or other fastening device. In other embodiments, the nozzle assembly index 39 can be a snap-on construction, injection-molded, fastened or otherwise attached to the nozzle assembly collar 98. Screw 102 couples the elongated outer housing 46 together. The elongated outer housing 46 interfaces with the nozzle assembly collar 98 for turning and rotating the nozzle assembly index 39. As illustrated in FIG. 7*a*, the nozzle assembly 38 further comprises an o-ring 43 to retain a seal between the nozzle assembly index 39 and the nozzle coupler 94. In some embodiments, the o-ring 43 can be a rubber seal or the like for maintaining a seal between the nozzle assembly index 39 and the nozzle coupler 94. In some embodiments, a spring-loaded détente 99 can hold the nozzle assembly index 98 in place once the user selects a nozzle 42.

A tube portion 62 separates the fitting 18 from the nozzle assembly 38. Due to the high pressure within the tube portion 62, preferred constructions employ cylindrical steel tubes with other shapes and materials being possible. Although the construction illustrated in FIG. 5 includes positions for six nozzles, it should be evident that fewer or more nozzles could be employed.

An elongated outer housing 46 surrounds the tube portion 62 of the wand assembly 14. In some embodiments, the elongated outer housing 46 is made from a rigid, plastic material. However, in other embodiments, the elongated outer housing 46 can be made from a metal alloy. The interior of the elongated outer housing 46 supports a plurality of housing recesses 66 to receive and retain the tube portion 62. In the illustrated embodiment, the elongated outer housing 46 includes a hand grip 50. The hand grip 50 is located near the input end 30. However, in other embodiments, the hand grip 50 may be located on the elongated outer housing 46 between the input end 30 and the output end 34.

As further illustrated in FIG. 4, the wand assembly 14 includes a nozzle indicator 70, which is coupled to the elongated outer housing 46. The elongated outer housing 46 further includes a view window 54. The view window 54 comprises a view aperture 74, which may optionally be covered by a transparent portion of glass, plastic, or similar material. The view window 54 is configured so that a visual indicator 82 is visible to the user. The visual indicator 82 is a text, icon, number, color, or other indicator that indicates the spray characteristics of the selected nozzle to the user.

Figure 10:
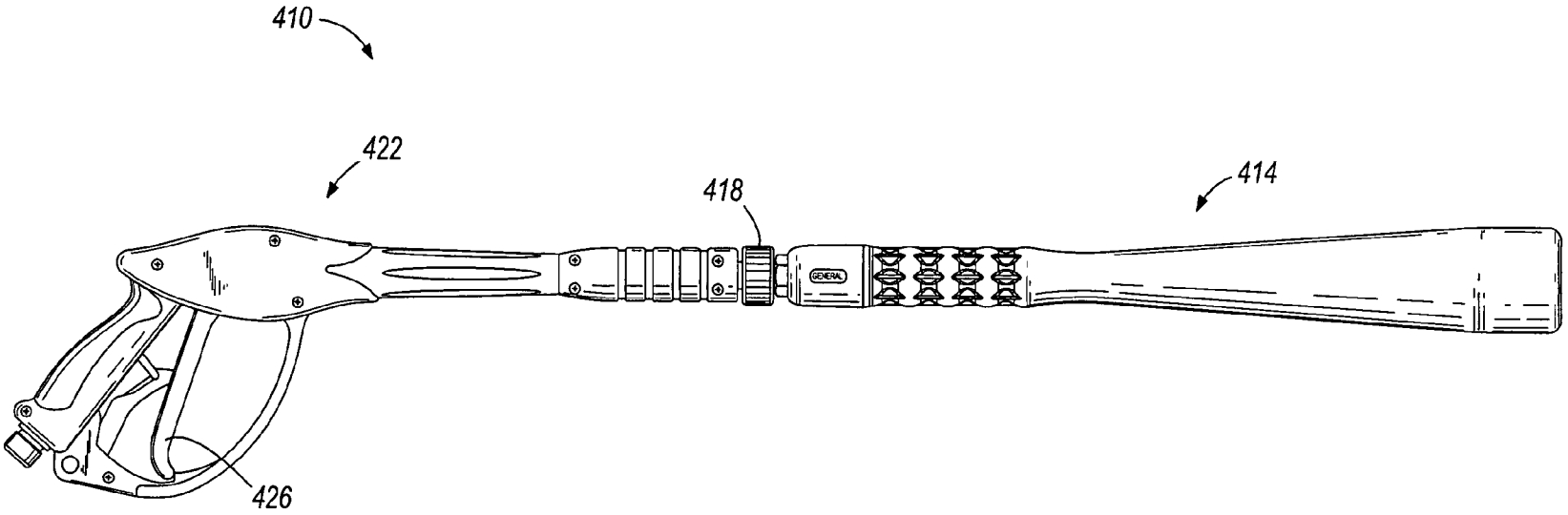
FIG. 10 is a perspective view of a pressure washer assembly of another embodiment of a pressure washer wand assembly.

In operation and with reference to FIG. 10, the gun assembly 422 includes a trigger 426 that controls a trigger or output valve. The valve, when actuated, ports high-pressure fluid from a high-pressure source (e.g., an engine-driven pump on a pressure washer) to the pressure washer wand assembly. When not actuated, the valve prevents flow beyond the fitting 418. When the trigger 426 is actuated, the high-pressure flow exits the gun assembly 422 and flows into the tube portion of the wand assembly.

Figure 6:
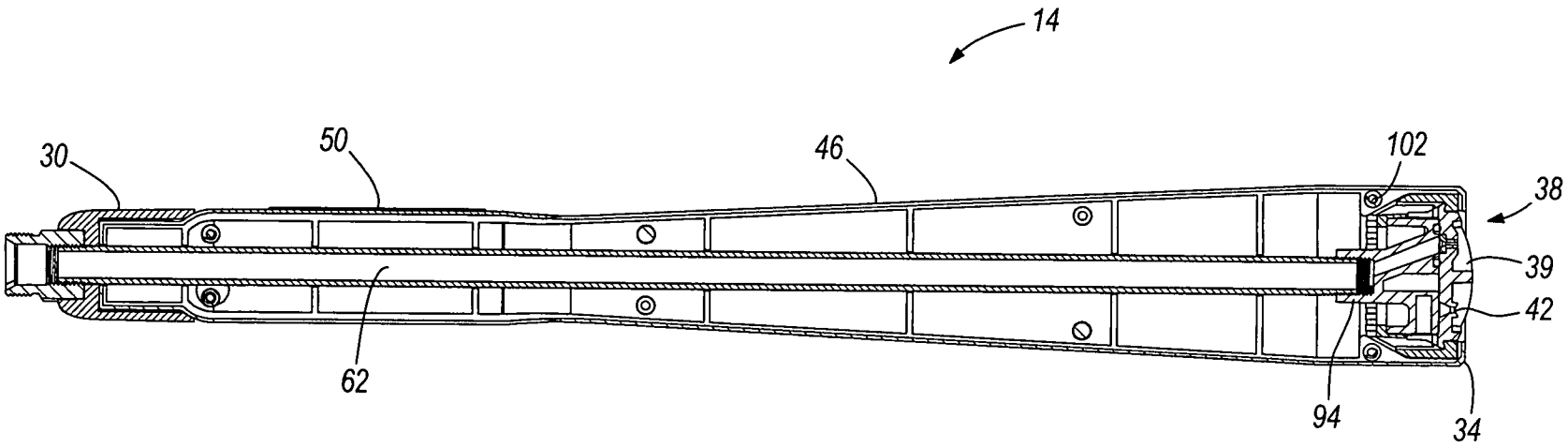
FIG. 6 is a cross-sectional view of the pressure washer wand assembly shown in FIG. 1.
Figure 7:
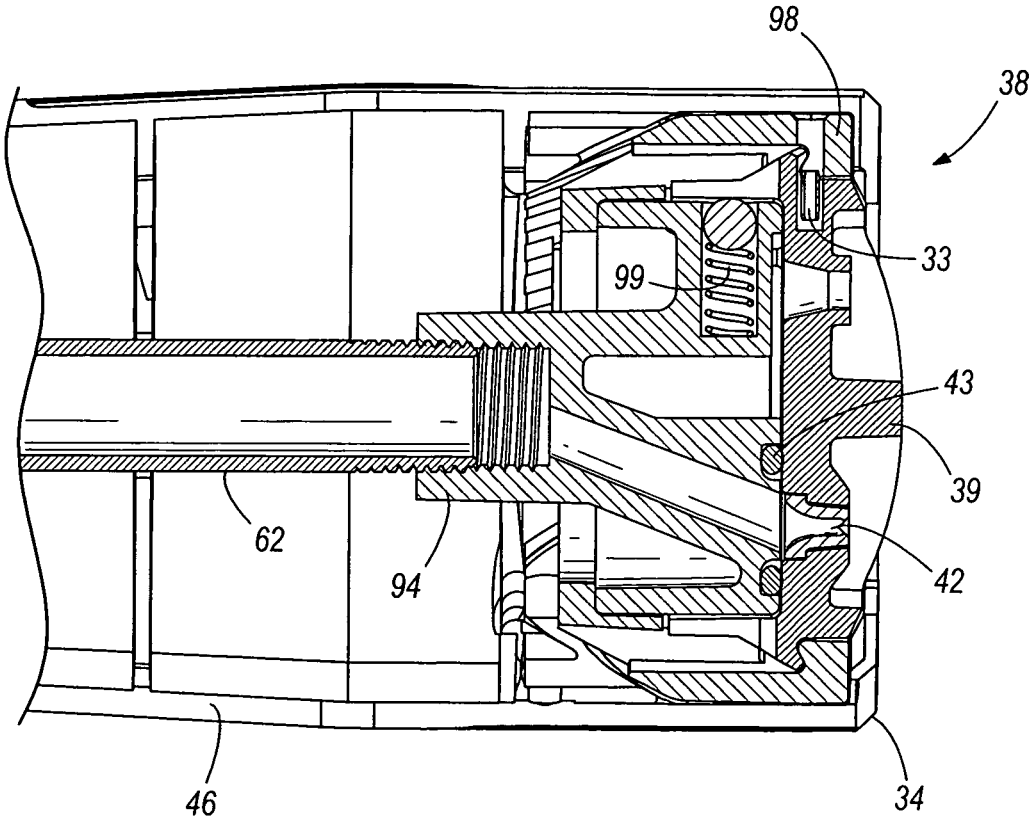
FIG. 7 is a detailed cross-sectional view of the nozzle assembly of the pressure washer wan assembly shown in FIG. 6.
Figure 7A:
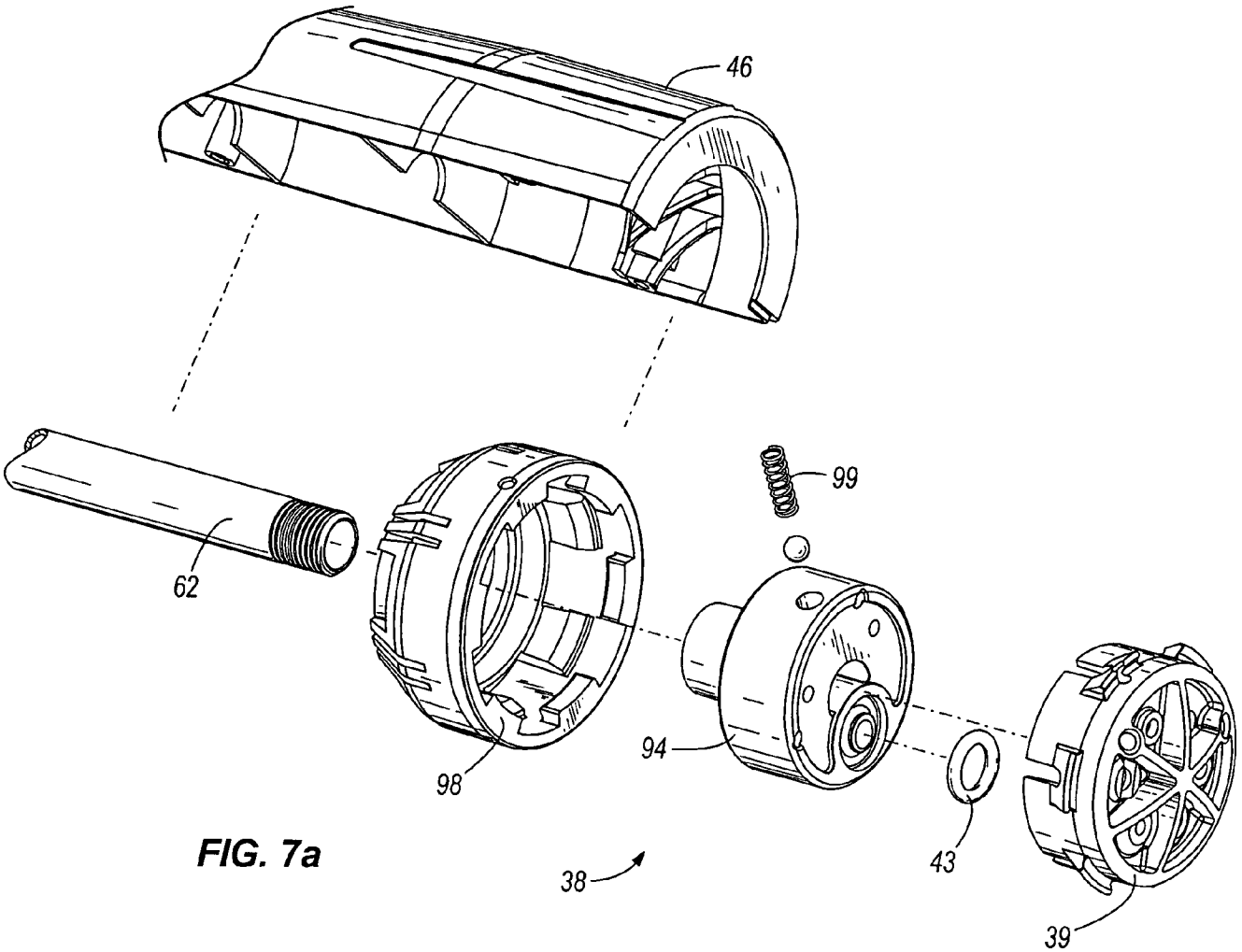
FIG. 7*a* is an exploded view of the detailed cross-sectional view of the nozzle assembly of the pressure washer wand assembly shown in FIG. 7.

In the illustrated embodiment and with reference to FIGS. 4, 6 and 7, the user rotates the elongated outer housing 46 using the hand grip 50. The elongated outer housing 46 is coupled to the nozzle coupler 94, which is further coupled to the nozzle assembly index 39 and configured to rotate with respect to the tube portion 62. When the elongated outer housing 46 is rotated a predetermined amount, a nozzle 42 is selected from the nozzle assembly 38 at the output end 34. The nozzle indicator 70 is coupled to the elongated outer housing 46. The nozzle indicator 70 is configured to indicate the spray characteristic of the selected nozzle 42. In some embodiments, the nozzle indicator 70 may be configured to rotate with the nozzle assembly 38. The nozzle indicator 70 and an associated visual indicator 82 are visible to the user through the view window 54 in the elongated outer housing 46. The visual indicator 82 displays a text, icon, number, color or other indicator that is indicative of the spray characteristics of the selected nozzle. By way of example only, the word "PINPOINT" or the color red could be used to indicate a high pressure, small spray angle nozzle.

Figure 8:
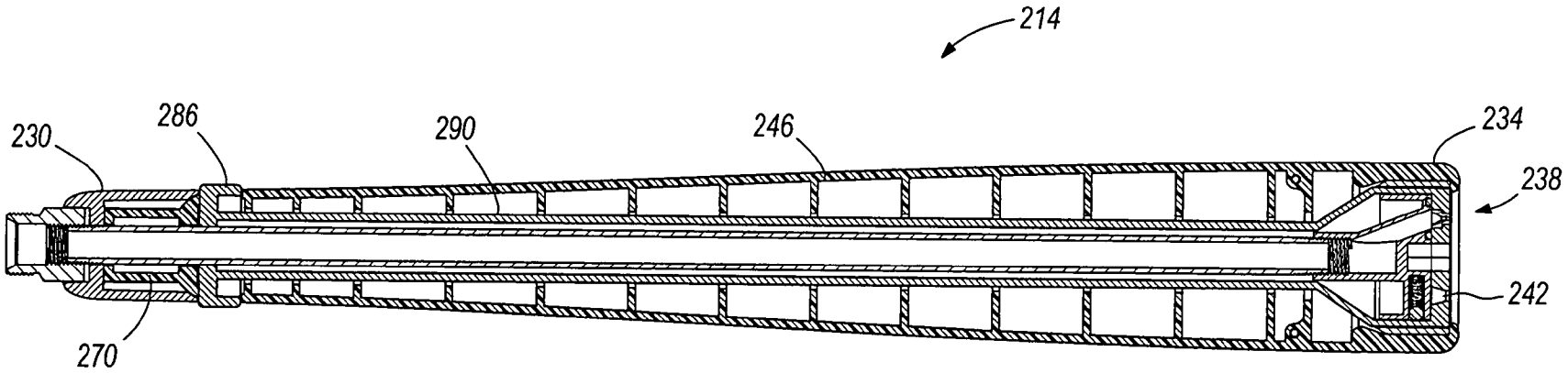
FIG. 8 is a cross-sectional view of another embodiment of a pressure washer wand assembly.

In another embodiment and with reference to FIG. 8, the wand assembly 214 can further include a nozzle selector 286. The nozzle selector 286 is wheel-shaped and is spaced from the output end 234. In some embodiments, the nozzle selector 286 is near the input end 230 of the wand assembly 214. An elongated member 290 is integrally formed with the nozzle selector 286 and the nozzle assembly 238 to couple the nozzle selector 286 to the nozzle assembly 238. In the illustrated embodiment, when rotated by the user, the nozzle selector 286 is configured to rotate and select a nozzle 242 from the nozzle assembly 238 at the output end 234 when the nozzle selector 286 is rotated a predetermined amount. In this embodiment, the elongated outer housing 246 does not rotate. The nozzle indicator 270 is coupled to the elongated member 290 and is configured to rotate with the nozzle assembly 238. The nozzle indicator 270 is configured to indicate the selected spray characteristics of the nozzle selected. The nozzle indicator 270 and associated visual indicator are visible to the user through the view window in the elongated outer housing 246. The visual indicator displays text, icon, number, color or another indicator that is meaningful to the wand user.

Figure 9:
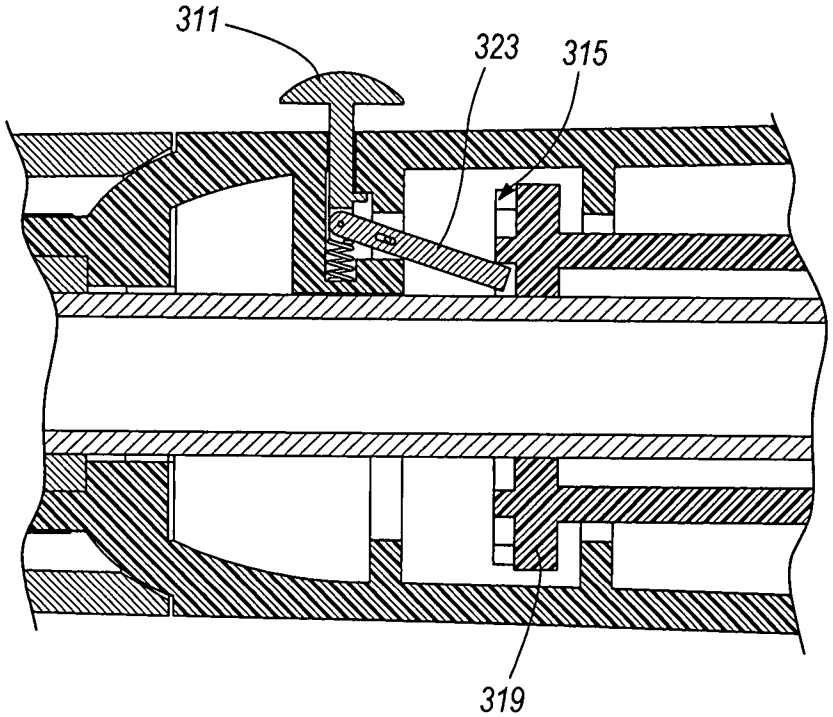
FIG. 9 is a ratchet-type nozzle selector according to the present invention.

In other embodiments, the nozzle selector does not rotate. As shown in FIG. 9, the nozzle selector may instead utilize a lever 311 to engage a ratchet mechanism 315 to select a nozzle. The ratchet mechanism 315 includes a ratchet 319 and a pawl 323. In some embodiments, a remote nozzle selector is disposed near the input end of the wand, or is otherwise spaced from the output end. The remote nozzle selector can alternately comprise a series of buttons or similar selectors, each corresponding to a nozzle with a selected spray characteristic. By manipulating the remote nozzle selector buttons, the user can select a nozzle with a particular spray characteristic. In any case, a remote nozzle indicator may also be provided that is spaced from the output end of the wand, preferably near the nozzle selector.

In another embodiment and with reference to FIG. 10, a pressure washer assembly 410 includes another embodiment of a pressure washer wand assembly 414, a fitting 418, a gun assembly 422, a trigger 426 and a power unit. The power unit can be an engine, electric motor or other power source that provides a pressurized fluid to the pressure washer assembly 410.

Figure 11:
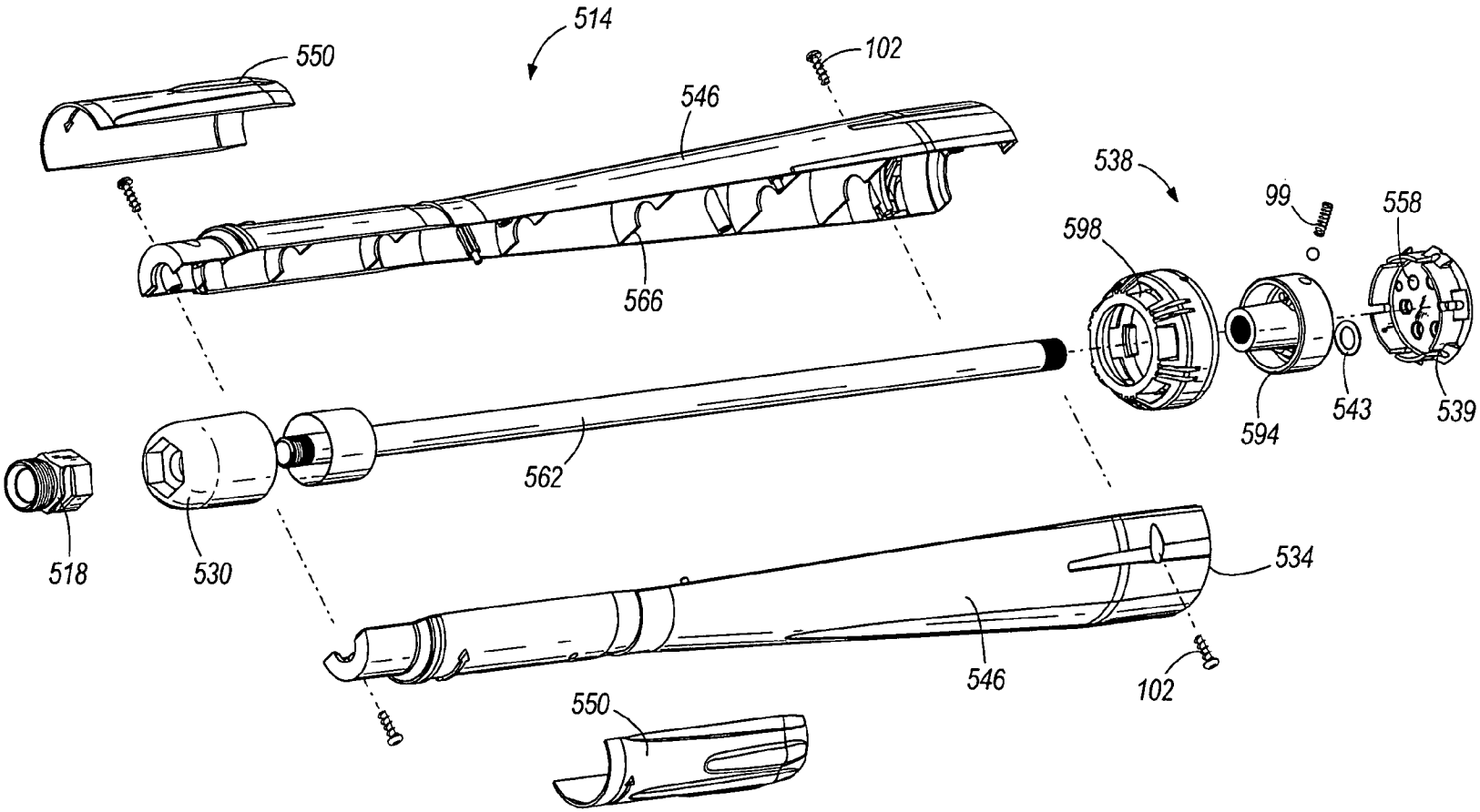
FIG. 11 is an exploded view of another embodiment of a pressure washer assembly.

In other embodiments and with reference to FIG. 11, the nozzle assembly 538 can be press-fit or otherwise attached to a pressure washer wand assembly 514. The nozzle assembly index 539 is further coupled to the nozzle assembly collar 598 with a pin. The nozzle assembly 538 of the pressure washer wand assembly 514 is coupled to the output end 534 with a nozzle assembly collar 598 at the exterior of the output end 534. The nozzle assembly 538 includes a plurality of apertures 558, with each of the apertures containing a nozzle. The elongated outer housing 546 is coupled to the nozzle coupler 594, which is further coupled to the nozzle assembly index 539 and configured to rotate with respect to the tube portion 562. An o-ring 543 is positioned between the nozzle assembly index 539 and nozzle coupler 594. In some embodiments, a spring-loaded détente 99 can hold the nozzle assembly index 539 in place once the user selects a nozzle.

The pressure washer assembly of FIG. 11 further includes an input end 530 and a hand grip 550. The tube portion 562 is received and retained by housing recesses 566 and separates the fitting 518 from the nozzle assembly 538. Screws or fasteners 102 couple the elongated outer housing 546 together.

Although the invention has been described in detail with reference to certain preferred embodiments, variations and modifications exist within the scope and spirit of the invention as described and defined in the following claims.

What is claimed is:

1. A pressure washer wand assembly configured to discharge pressurized fluid in a changeable spray pattern, the wand assembly comprising:

a rigid tube portion having an input end and an output end defining therebetween a longitudinal axis;

a nozzle coupler attached to the rigid tube portion and including a single passageway that is offset from and not symmetric about the longitudinal axis;

a nozzle assembly index having a plurality of selectable nozzles, the nozzle assembly index disposed downstream of the passageway and configured to discharge the pressurized fluid in a spray pattern, all of the pressurized fluid passing through the passageway before being discharged through any of the selectable nozzles;

a nozzle assembly collar coupled for co-rotation with the nozzle assembly index, at least a portion of the nozzle coupler being received within the nozzle assembly collar for rotatably supporting the nozzle assembly collar thereon;

a seal positioned between the nozzle coupler and the nozzle assembly index, the pressurized fluid in the tube portion first passing through an aperture in the seal prior to being discharged through one of the nozzles;

a nozzle indicator disposed upstream of the output end that indicates a spray characteristic of a selected nozzle; and an elongated outer housing coupled for co-rotation with the nozzle assembly index and containing therein substantial lengths of the tube portion, the nozzle coupler, the nozzle assembly index, and the nozzle assembly collar, wherein the housing is configured to rotate with respect to the tube portion to select the selected nozzle.

2. The pressure washer wand assembly of claim 1, wherein the nozzle assembly collar is press fit to the outer housing near the output end of the tube portion.

3. The pressure washer wand assembly of claim 1, wherein the nozzle indicator is rotatable.

4. The pressure washer wand assembly of claim 1, wherein the nozzle indicator is configured to rotate with the nozzle assembly index.

5. The pressure washer wand assembly of claim 4, wherein the nozzle indicator is located between the input end and the output end of the tube portion.

6. The pressure washer wand assembly of claim 5, wherein the nozzle indicator is located near the input end of the tube portion.

7. The pressure washer wand assembly of claim 1, further comprising a view window through which the nozzle indicator is viewable, wherein the view window is located between the input end and the output end of the tube portion.

8. The pressure washer wand assembly of claim 7, wherein the view window is located near the input end of the tube portion.

9. The pressure washer wand assembly of claim 1, wherein the nozzle indicator includes at least one of text, an icon, a color, and a number.

10. The pressure washer wand assembly of claim 1, wherein the seal is received within a recess in the nozzle coupler, and wherein the seal is in sliding contact with the nozzle assembly index in response to rotation of the nozzle assembly index.

11. The pressure washer wand assembly of claim 10, wherein the seal is radially offset from a rotational axis of the nozzle assembly index.

12. A pressure washer wand assembly configured to discharge pressurized fluid in a changeable spray pattern, the wand assembly comprising:

a rigid tube portion having an input end and an output end defining therebetween a longitudinal axis;

an elongated outer housing containing therein a substantial length of the tube portion;

a nozzle coupler attached to and extending from the output end of the rigid tube portion, the nozzle coupler including a passageway that is offset from the longitudinal axis;

a nozzle assembly index having a plurality of selectable nozzles, the nozzle assembly index disposed downstream of the passageway and configured to discharge the pressurized fluid in a spray pattern;

a nozzle assembly collar coupled for co-rotation with the nozzle assembly index, at least a portion of the nozzle coupler being received within the nozzle assembly collar for rotatably supporting the nozzle assembly collar thereon;

a seal positioned to form a seal between the nozzle coupler and the nozzle assembly index and defining a seal interior and a seal exterior, the pressurized fluid in the tube portion first passing through the seal interior prior to being discharged through one of the nozzles, the seal arranged to prevent the flow of fluid around the seal exterior for each selected nozzle; and a nozzle selector positioned near the input end, upstream of the output end, and coupled for co-rotation with the nozzle assembly index to select a nozzle from the nozzle assembly index;

wherein the elongated outer housing also contains therein substantial lengths of the nozzle coupler, the nozzle assembly index, and the nozzle assembly collar.

13. The pressure washer wand assembly of claim 12, wherein the nozzle assembly collar is press fit to the outer housing near the output end of the tube portion.

14. The pressure washer wand assembly of claim 12, wherein the wand assembly further comprises a nozzle indicator indicating a spray characteristic of the selected nozzle.

15. The pressure washer wand assembly of claim 14, wherein the nozzle indicator includes at least one of text, an icon, a color, and a number.

16. The pressure washer wand assembly of claim 12, wherein the nozzle assembly index and the nozzle selector are rotatable relative to the rigid tube portion.

17. The pressure washer wand assembly of claim 16, wherein an elongated member couples the nozzle selector to the nozzle assembly index.

18. The pressure washer wand assembly of claim 17, wherein the elongated member is disposed within the elongated outer housing.

19. The pressure washer wand assembly of claim 18, further comprising:

a nozzle indicator that indicates a spray characteristic of a selected nozzle, the nozzle indicator coupled for co-rotation with the nozzle selector, and a view window through which the nozzle indicator is viewable, wherein the view window located between the input end and the output end of the tube portion.

20. The pressure washer wand assembly of claim 17, wherein the elongated member is disposed adjacent the tube portion.

21. A pressure washer wand assembly configured to discharge pressurized fluid in a changeable spray pattern, the wand assembly comprising:

a rigid tube portion having an input end and an output end defining therebetween a longitudinal axis;

an elongated outer housing containing therein a substantial length of the tube portion;

a nozzle coupler attached to and extending from the output end of the rigid tube portion, the nozzle coupler including a passageway that is offset from the longitudinal axis;

a nozzle assembly index having a plurality of selectable nozzles, the nozzle assembly index disposed downstream of the passageway and configured to discharge the pressurized fluid in a spray pattern;

a nozzle assembly collar coupled for co-rotation with the nozzle assembly index, at least a portion of the nozzle coupler being received within the nozzle assembly collar for rotatably supporting the nozzle assembly collar thereon;

a seal positioned between the nozzle coupler and the nozzle assembly index, the pressurized fluid in the tube portion first passing through an aperture in the seal prior to being discharged through one of the nozzles; and a nozzle selector positioned near the input end, upstream of the output end, and coupled for co-rotation with the nozzle assembly index to select a nozzle from the nozzle assembly index; wherein the elongated outer housing also contains therein substantial lengths of the nozzle coupler, the nozzle assembly index, and the nozzle assembly collar, wherein the nozzle assembly index and the nozzle selector are rotatable relative to the rigid tube portion, wherein an elongated member couples the nozzle selector to the nozzle assembly index, and wherein the elongated member includes a second tube portion.

22. The pressure washer wand assembly of claim 12, wherein the nozzle selector includes a ratchet and a pawl.

23. The pressure washer wand assembly of claim 12, wherein the seal is received within a recess in the nozzle coupler, and wherein the seal is in sliding contact with the nozzle assembly index in response to rotation of the nozzle assembly index.

24. The pressure washer wand assembly of claim 23, wherein the seal is radially offset from a rotational axis of the nozzle assembly index.

25. A pressure washer wand assembly configured to discharge pressurized fluid in a changeable spray pattern, the wand assembly comprising:

a rigid tube portion having an input end and an output end defining therebetween a longitudinal axis;

a nozzle coupler attached to the rigid tube portion and including a passageway that is offset from the longitudinal axis;

a nozzle assembly index having a plurality of selectable nozzles, the nozzle assembly index disposed downstream of the passageway and configured to discharge the pressurized fluid in a spray pattern;

a nozzle assembly collar coupled for co-rotation with the nozzle assembly index, at least a portion of the nozzle coupler being received within the nozzle assembly collar for rotatably supporting the nozzle assembly collar thereon;

a seal positioned between the nozzle coupler and the nozzle assembly index, the pressurized fluid in the tube portion first passing through an aperture in the seal prior to being discharged through one of the nozzles;

an elongated, rotatable outer housing containing therein substantial lengths of the tube portion, the nozzle coupler, the nozzle assembly index, and the nozzle assembly collar;

a nozzle selector positioned near the input end, upstream of the output end, and configured to select a nozzle from the nozzle assembly index; and a nozzle indicator positioned near the input end, upstream of the output end, that indicates a spray characteristic of a selected nozzle, wherein the nozzle indicator is configured to rotate with the nozzle assembly index and with the elongated, rotatable outer housing, and wherein the housing is configured to rotate with respect to the tube portion to select the selected nozzle, wherein the nozzle assembly collar and the nozzle assembly index are formed as separate components.

26. The pressure washer wand assembly of claim 25, wherein the nozzle assembly collar is press fit to the outer housing near the output end of the tube portion.

27. The pressure washer wand assembly of claim 25, wherein the outer housing has a hand grip.

28. The pressure washer wand assembly of claim 25, wherein the elongated, rotatable outer housing is coupled to the nozzle assembly index and configured to rotate with respect to the tube portion to select a nozzle from the nozzle assembly index.

29. The pressure washer wand assembly of claim 25, further comprising a view window through which the nozzle indicator is viewable, wherein the view window is located near the input end of the tube portion.

30. The pressure washer wand assembly of claim 25, wherein the nozzle indicator includes at least one of text, an icon, a color, and a number.

31. The pressure washer wand assembly of claim 25, wherein the seal is received within a recess in the nozzle coupler, and wherein the seal is in sliding contact with the nozzle assembly index in response to rotation of the nozzle assembly index.

32. The pressure washer wand assembly of claim 31, wherein the seal is radially offset from a rotational axis of the nozzle assembly index.

33. A pressure washer wand assembly configured to discharge pressurized fluid in a changeable spray pattern, the wand assembly comprising:

a rigid tube portion having an input end and an output end defining therebetween a longitudinal axis;

a nozzle coupler attached to the rigid tube portion and including a passageway that is offset from the longitudinal axis;

a nozzle assembly index having a plurality of selectable nozzles, the nozzle assembly index disposed downstream of the passageway and configured to discharge the pressurized fluid in a spray pattern;

a nozzle assembly collar coupled for co-rotation with the nozzle assembly index, at least a portion of the nozzle coupler being received within the nozzle assembly collar for rotatably supporting the nozzle assembly collar thereon;

a seal positioned between the nozzle coupler and the nozzle assembly index, the pressurized fluid in the tube portion first passing through an aperture in the seal prior to being discharged through one of the nozzles;

a nozzle indicator disposed upstream of the output end that indicates a spray characteristic of a selected nozzle; and an elongated outer housing coupled for co-rotation with the nozzle assembly index and containing therein substantial lengths of the tube portion, the nozzle coupler, the nozzle assembly index, and the nozzle assembly collar, wherein the housing is configured to rotate with respect to the tube portion to select the selected nozzle, wherein the nozzle assembly collar and the nozzle assembly index are formed as separate components.

34. A pressure washer wand assembly configured to discharge pressurized fluid in a changeable spray pattern, the wand assembly comprising:

a rigid tube portion having an input end and an output end defining therebetween a longitudinal axis;

an elongated outer housing containing therein a substantial length of the tube portion;

a nozzle coupler attached to and extending from the output end of the rigid tube portion, the nozzle coupler including a passageway that is offset from the longitudinal axis;

a nozzle assembly index having a plurality of selectable nozzles, the nozzle assembly index disposed downstream of the passageway and configured to discharge the pressurized fluid in a spray pattern;

a nozzle assembly collar coupled for co-rotation with the nozzle assembly index, at least a portion of the nozzle coupler being received within the nozzle assembly collar for rotatably supporting the nozzle assembly collar thereon;

a seal positioned between the nozzle coupler and the nozzle assembly index, the pressurized fluid in the tube portion first passing through an aperture in the seal the seal interior prior to being discharged through one of the nozzles; and a nozzle selector positioned near the input end, upstream of the output end, and coupled for co-rotation with the nozzle assembly index to select a nozzle from the nozzle assembly index; wherein the elongated outer housing also contains therein substantial lengths of the nozzle coupler, the nozzle assembly index, and the nozzle assembly collar, wherein the nozzle assembly collar and the nozzle assembly index are formed as separate components.

* * * * *